US006886770B2

(12) United States Patent
Göbbels et al.

(10) Patent No.: US 6,886,770 B2
(45) **Date of Patent: *May 3, 2005**

(54) CYLINDRICAL CHEESE AND METHOD FOR FORMING THE WOUND PACKAGE OF A CYLINDRICAL CHEESE

(75) Inventors: Heinz-Dieter Göbbels, Mönchengladbach (DE); Gregor Gebald, Mönchengladbach (DE); Friedemann Söll, Mönchengladbach (DE)

(73) Assignee: Saurer GmbH & Co. KG, Moenchengladbach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/324,477

(22) Filed: Dec. 20, 2002

(65) Prior Publication Data

US 2003/0116672 A1 Jun. 26, 2003

(30) Foreign Application Priority Data

Dec. 20, 2001 (DE) ..... 101 62 777

(51) Int. Cl.[7] ..... B65H 34/38; B65H 34/32

(52) U.S. Cl. ..... 242/477.3; 242/483.6; 242/480.9; 242/178

(58) Field of Search ..... 242/477.3, 483.6, 242/480.9, 178

(56) References Cited

U.S. PATENT DOCUMENTS

| | | | | |
|---|---|---|---|---|
| 954,344 A | | 4/1910 | Rhoades | |
| 1,789,702 A | | 1/1931 | Fromonot | |
| 2,281,747 A | | 5/1942 | Campbell | 242/43 |
| 2,301,713 A | | 11/1942 | Seem et al. | 242/159 |
| 3,402,898 A | | 9/1968 | Mattingly | 242/43 |
| 3,638,872 A | * | 2/1972 | Jennings | 242/477.3 |
| 3,991,950 A | | 11/1976 | Tashiro et al. | 242/18 |
| 4,102,506 A | | 7/1978 | Raasch et al. | 242/18 |
| 4,266,734 A | | 5/1981 | Raasch | 242/18 |
| 4,771,960 A | | 9/1988 | Yamamoto et al. | 242/18.1 |
| 6,065,712 A | * | 5/2000 | Mayer et al. | 242/477.2 |
| 6,443,379 B2 | * | 9/2002 | Lassmann | 242/178 |
| 2002/0040946 A1 | | 4/2002 | Lassmann | 242/477.5 |

FOREIGN PATENT DOCUMENTS

| | | |
|---|---|---|
| CH | 575 878 | 11/1976 |
| CH | 597 075 | 10/1977 |
| DE | DT 2 330 650 | 6/1973 |
| DE | 26 32 014 | 7/1976 |
| DE | 38 25 413 A1 | 2/1990 |
| DE | 43 10 905 A1 | 10/1994 |
| DE | 100 15 933 | 3/2000 |
| JP | 2000335824 | 12/1990 |
| JP | 08282916 | 10/1996 |

OTHER PUBLICATIONS

European Search Report.
German Search Report.

* cited by examiner

*Primary Examiner*—Kathy Matecki
*Assistant Examiner*—E. Langdon
(74) *Attorney, Agent, or Firm*—Kennedy Covington Lobdell & Hickman, LLP

(57) ABSTRACT

A method for forming the wound package of cylindrical cheeses on rotor spinning machines, wherein a crossing angle $\alpha_M$ in a central zone of the bobbin traverse is less than 28° and a crossing angle $\alpha_R$ in the end zones located adjacent the ends of the wound package is increased in respect to the central zone. The cylindrical cheeses thereby produced are distinguished by great running lengths, solid structure, good density distribution, and excellent unwinding properties.

10 Claims, 3 Drawing Sheets

CYLINDRICAL CHEESE AND METHOD FOR FORMING THE WOUND PACKAGE OF A CYLINDRICAL CHEESE

CROSS-REFERENCE TO RELATED APPLICATIONS

This application claims the benefit of German patent application DE P 101 62 777.7, filed Dec. 20, 2001, herein incorporated by reference.

FIELD OF THE INVENTION

The present invention relates to a cylindrical cheese and a method for forming the wound package of a cylindrical cheese with a yarn guide device.

BACKGROUND OF THE INVENTION

Yarn produced on rotor spinning frames differs in its bobbin building and unwinding behavior from ring-spun yarn. The rotor yarn is less napped than the ring-spun yarn and, therefore, is easier to unwind (greater ease of release). However, the rotor yarn has a greater curling tendency than the ring-spun yarn, causing the wound-up yarn in the edge areas of the cheese to be pushed outward by the yarn layers located on top. Because of this, a cheese can be formed which exceeds the normal bobbin traverse of, for example, 150 mm and can grow up to a width of 170 to 180 mm. Consequently, the desired bobbin buildup with level end faces is no longer possible. Such appearances occur with yarns made of natural fibers, such as cotton and, in particular, with coarse yarns. Coarser yarns produce a more marked distortion of the bobbin end faces.

Problems at the end faces of wound packages can already appear in the pre-stage of yarn production with wound-up fiber slubbing or roving yarn. U.S. Pat. No. 954,344 discloses that bulges will occur in the build-up of the end faces of wound packages if slubbings or rovings are not twisted or are only slightly twisted. This problem occurs if the winding angle is greater than 32°, which is customary in the prior art. In addition, the soft and loose structure of the fiber strands will contribute to the problem. Bulges can considerably impair the further processing of the wound packages. As disclosed in U.S. Pat. No. 954,344, the bulging can be prevented by increasing the winding angle in the end edge areas of the wound package, while keeping the winding angle the same in the rest of the areas of the wound package.

If cheese winding is performed at high yarn speeds, it is possible with medium and coarse yarns, because of the mass inertia of the yarn, for the yarn to move past the bobbin edge at the reversing points of the traverse and to create a so-called skipped yarn error. This fault leads to yarn breaks and hampers the further processing of the yarn.

The possibility of the occurrence of such errors is considerably affected by the crossing angle $\alpha$. Therefore the selection of the appropriate crossing angle is of great importance when producing cheeses. When a cheese is produced with "random cross winding," the yarn crossing angle remains constant over the entire bobbin travel. On the other hand, when a cheese is produced using "precision winding," the yarn crossing angle is reduced as the cheese diameter increases. One advantage of precision winding over random cross winding is that precision winding produces a cheese with more running length, given the same bobbin volume. However, the crossing angle, which is reduced with increasing cheese diameter, limits the permissible maximum diameter when producing precision bobbins made of staple fiber yarns, since it is not possible to perform winding at arbitrarily narrow crossing angles with staple fiber yarns in order to avoid the defects occurring at the edges. For this reason, and as described, for example, in generic German Patent Publication DE 100 15 933 A1, crossing angles of less than 28° should be avoided in rotor spinning. Therefore, precision winding can only be used to a limited extent, particularly when winding staple fiber yarns.

In a third type of winding referred to as "step precision winding," the goal is a crossing angle that remains approximately the same. In actual use, the above described density problems, or problems with the stability of the bobbin end edges, are somewhat reduced by means of step precision winding, but are not solved.

With conical cheeses which are driven by circumferential friction by a roller, it is necessary to let the drive be effective only within a predetermined area of a narrow friction zone, or of the friction zone of the cheese. Since the length of the bobbin circumference viewed along the bobbin axis differs, the number of revolutions of the cheese begins to fluctuate and becomes uncontrollable if the conical cheese to be wound comes into contact with the portions of the roller-shaped drive mechanism located to the left and right of the predetermined friction zone as the bobbin diameter grows. To prevent this occurrence, the yarn crossing angle in an area limited to the friction zone of a conical cheese is reduced in comparison with the yarn crossing angle outside of the friction zone as represented in German Patent Publication DE-AS 26 32 014, or in the parallel U.S. Pat. No. 4,266,734. By means of this reduction in the crossing angle, the compressive strength of the wound package is slightly increased in the winding zone. However, the only reason for forming a drive zone with increased specific pressure of the bobbin resting on the drive roller by changing the yarn crossing angle is to compensate for the different circumferential bobbin length in the case of conical cheeses.

New machine technology, in particular in weaving, such as air nozzle power looms, for example, make greater demands on the unwinding properties of the yarn. These requirements cannot be met, or are only insufficiently met, by means of the known bobbin embodiments.

SUMMARY OF THE INVENTION

It is accordingly an object of the present invention to provide a cylindrical cheese that is improved in comparison with known cylindrical cheeses, and to provide a method for producing the cheese on rotor spinning frames, in particular when producing coarse yarns.

This object is addressed by a method of winding a yarn onto a bobbin core into the form of a cylindrical yarn cheese, the method comprising the steps of traversing a yarn guide along the bobbin core for winding the yarn onto the bobbin core at a yarn crossing angle $\alpha$ which changes as the formation of the cheese progresses, the traversing of a yarn guide executing a lesser crossing angle $\alpha_M$ in a central zone centrally along the bobbin core between about 15° and about 28°, and a greater crossing angle $\alpha_R$ in end zones outwardly of the central zone adjacent opposite ends of the bobbin core.

The present invention is based upon the knowledge that it is possible by having crossing angles in the edge area of the cheese that are larger than the crossing angles in the central part to clearly reduce the crossing angle in the remaining wider central portion in comparison with customary crossing angles without having to accept the known disadvantages that occur when the crossing angle is reduced over the entire winding width. In this case the crossing angle can be substantially reduced without resulting in an impermissible compaction of the cheese.

The present invention provides enhanced unwinding of the yarn from the cylindrical cheese. In accordance with the present invention, the yarn unwinding process is quieter with fewer loops and yarn entanglements, thereby permitting the use of higher yarn unwinding speeds. The bobbin buildup, in particular, at the end faces of the cylindrical cheese, is improved. Finally, with the same bobbin diameter, the traveling length of the yarn is shown to be clearly increased in comparison with a conventional cylindrical cheese.

In accordance with a preferred embodiment of the present invention, the crossing angle $\alpha$ enables an increase of the wound yarn length, while maintaining excellent stability and high density of the cylindrical wound package. The crossing angle $\alpha$ of the central zone advantageously and continuously increases from the crossing angle $\alpha_M$ of the central zone to the crossing angle $\alpha_R$ of the end zones. Each end zone can be of such size that it occupies no more than about 15% of the entire winding width $B_{WG}$ of the cheese.

In accordance with another feature of the present invention, the undesired high yarn tension in connection with crossing angles $\alpha$ that are less than 28° can be suppressed by reducing the bobbin contact pressure and yarn tension as the bobbin diameter increases. The bobbin contact pressure is known to be composed of the weight of the bobbin and the weight of the bobbin frame, as well as the force resulting from a torque provided, for example, by a torque sensor. The bobbin contact pressure can be reduced in such a way that not only is the bobbin weight compensated, but a relief beyond that occurs.

If a yarn guide, for example, a belt yarn guide, already exists at a winding head for generating the traversing movement, and the yarn guide's speed can be controlled separately from the number of bobbin revolutions, the method of the present invention for producing a cylindrical cheese can be executed in a simple manner without any additional structural outlay, and without exchanging yarn guide elements or programming of the machine controls.

The present invention permits the winding-up of even coarse yarns with relatively narrow crossing angles. For example, processing of cotton yarn of a metric count of 20 at a crossing angle $\alpha$ of 25° is still possible, along with good unwinding properties and large running lengths. Improved unwinding properties lead to the reduction of down times because of the fewer number of yarn breaks in the course of the further processing of the yarn bobbins. Since the running length of the wound package increases along with the reduction of the crossing angle, it is possible to wind approximately 15% to 25% more yarn on a cylindrical cheese in accordance with the present invention as compared with a conventional cylindrical cheese of the same bobbin diameter. This leads to a clear reduction in the number of cheeses of a batch. Not only are the down times for bobbin changes reduced at the spinning head as a result, but also the conveying outlay and the conveying volume for conveying the bobbins are reduced. It is possible to reduce the layout for handling the cheeses in the course of the subsequent yarn treatment processes.

The present invention improves productivity, lowers costs, and increases efficiency of yarn production and yarn processing.

Further details, features and advantages of the present invention will be explained in the following description of a preferred embodiment with reference to the accompanying drawings.

DESCRIPTION OF THE PREFERRED EMBODIMENT

Figure 1:
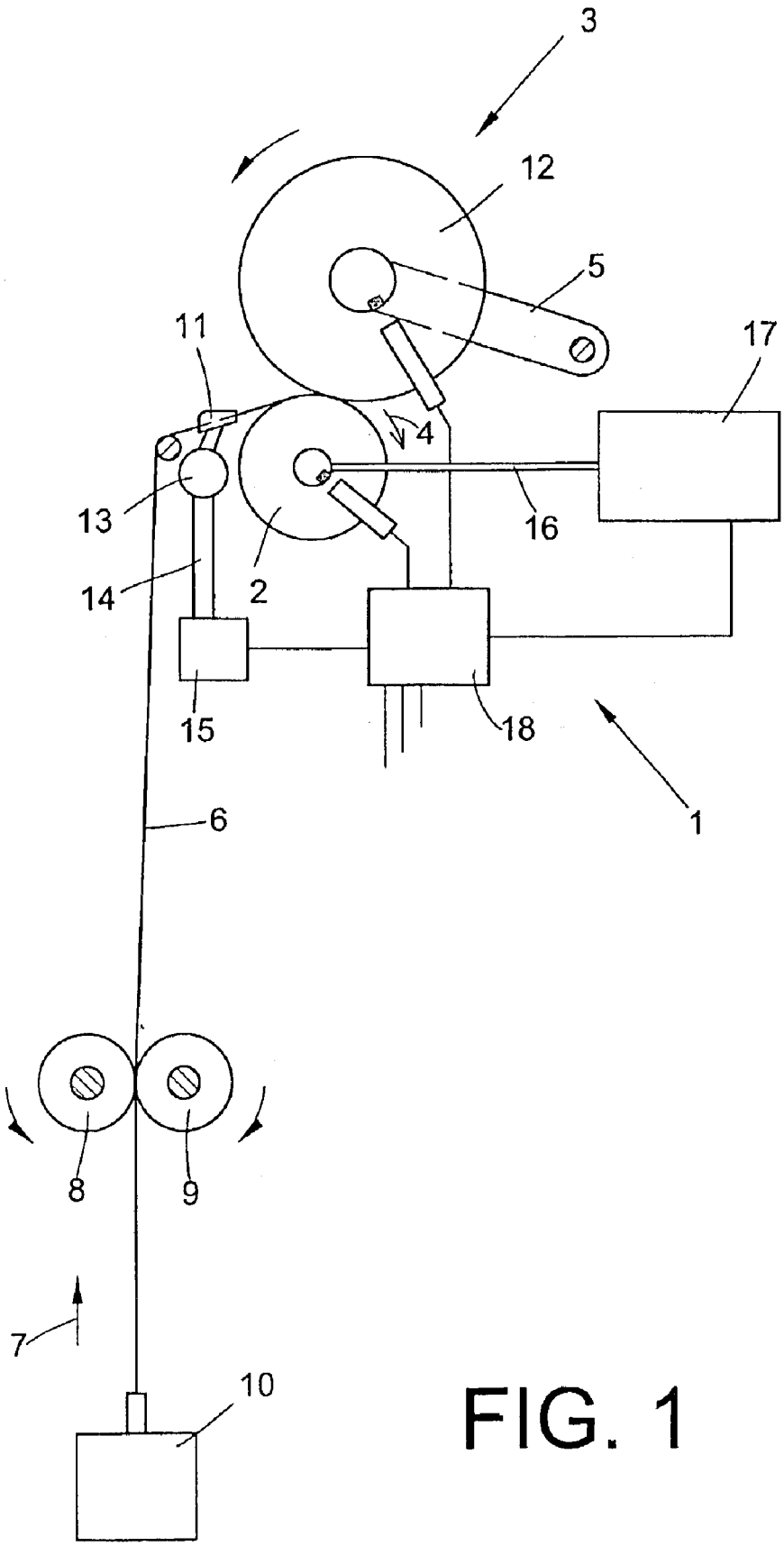
FIG. 1 is a simplified schematic side elevational view of a spinning head for executing the method in accordance with the present invention.

A winding device 1 at a spinning head of a rotor spinning frame producing cylindrical cheeses is represented in FIG. 1. The winding device 1 has a roller 2, which drives the cylindrical cheese 3 by means of friction. The roller 2 rotates in the direction of the arrow 4. The cheese 3 is held in a pivotable creel 5 and rests on the roller 2, which is charged with a contact pressure from the resting cheese 3. The yarn 6 is pulled at a constant yarn speed from the spinning box 10 of the spinning head in the direction of the arrow 7 by means of a cooperating pair of unwinding rollers 8, 9, and is wound up as the wound package 12 of the cheese 3 by means of a back-and-forth traversing yarn guide 11. The yarn guide 11 is a part of the traversing device 13, which is connected by means of an operative connection 14 with the motor 15 and is driven by the latter. The roller 2 is driven via the shaft 16 by a motor 17. The motor 15, as well as the motor 17, are controlled by a microprocessor 18, wherein the crossing angle $\alpha$ of the yarn on the cylindrical cheese 3 can be controlled during the respective bobbin traverse as a function of the position of the yarn guide 11.

Figure 2:
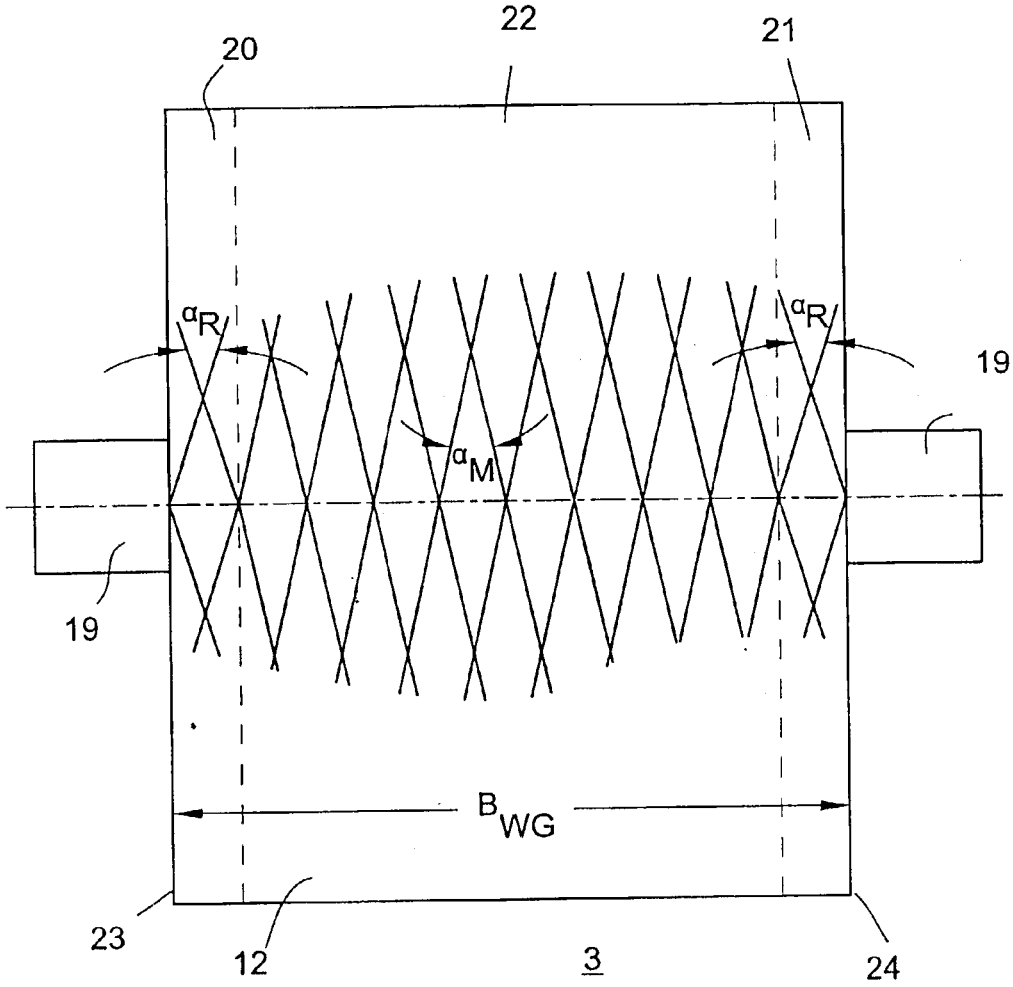
FIG. 2 is a basic elevational representation of a cylindrical cheese in accordance with the present invention.

The cylindrical cheese 3 represented in FIG. 2 shows a yarn package 12 wound in accordance with the present invention on the bobbin core 19. In the respective end zones 20, 21, the wound package 12 has a cross winding with a yarn crossing angle $\alpha_R$, and in the central zone 22 a cross winding with a yarn crossing angle $\alpha_M$. In the preferred embodiment of FIG. 2, the crossing angle $\alpha_R$ is 35°, and the crossing angle $\alpha_M$ is 25°. The width of the zone 22 (i.e., lengthwise along the yarn package), as well as that of the end zones 20, 21, are each marked by a dashed line. The cylindrical wound package 12 is shown in a simplified basic representation, wherein the respective course of the wound yarn 6 is only partially indicated, but reflects the crossing angles $\alpha$ of different sizes. In the preferred embodiment, the width $B_{WG}$ of the cheese 3 from the left bobbin end edge 23 to the right bobbin end edge 24 is 150 mm. The width $B_{WG}$ corresponds to one traverse of the yarn guide 11.

Because of the inertial forces, which can become effective at the high speeds of the traversing movement even with the relatively low mass of the yarn 6, in particular with coarse yarn, and which occur because of the back-and-forth movement of the yarn guide 11, the change of a value of the crossing angle $\alpha$ to a different value takes place gradually rather than abruptly, as shown in the representation in FIG. 2.

Figure 3:
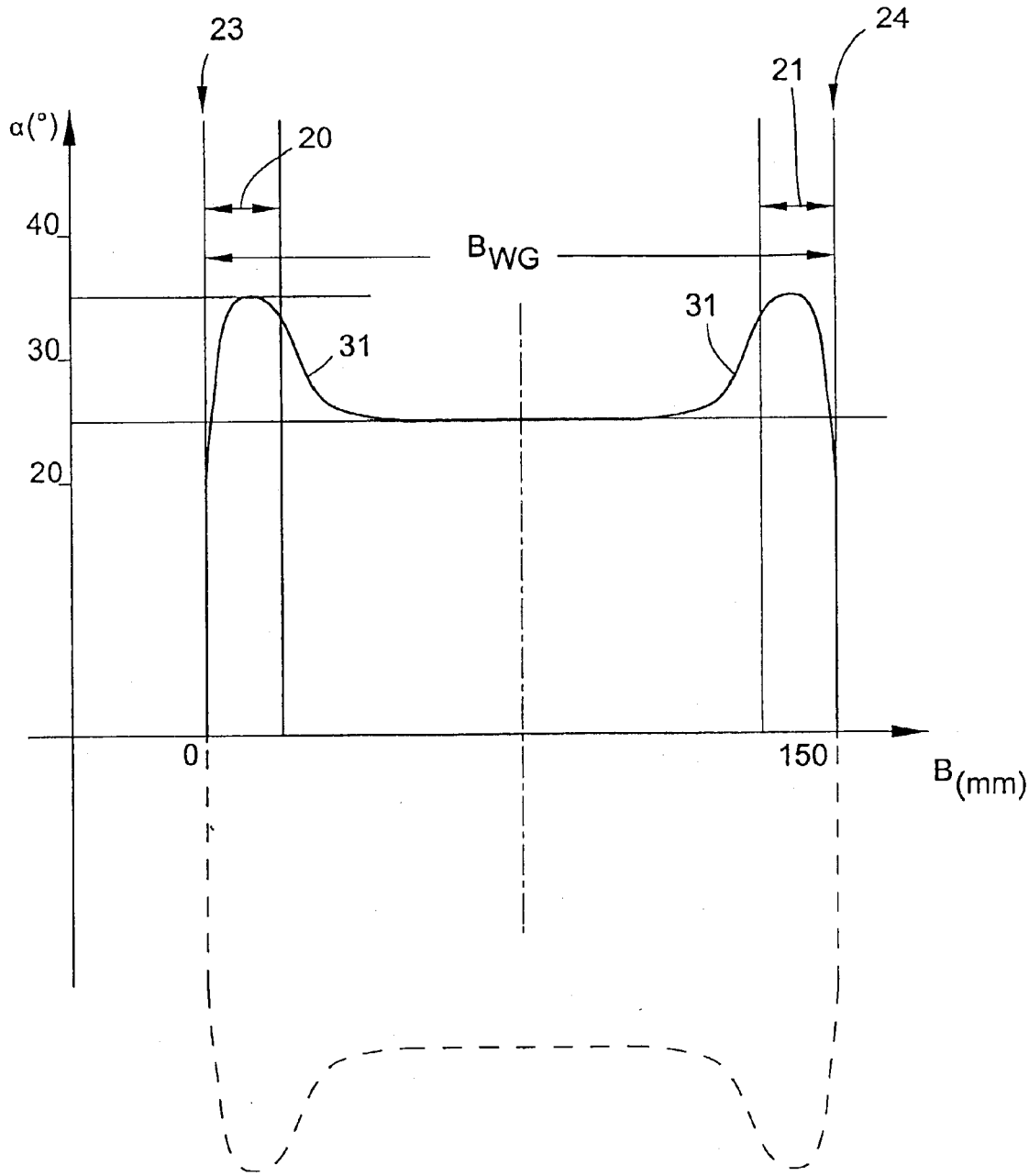
FIG. 3 is a graph representing the course of the crossing angle $\alpha$ over a traverse in the form of a curve.

Thus, the representation in FIG. 3 comes closer to the actual embodiment of the crossing angles $\alpha$ of the cheese 3, or the course of the yarn on the surfaces, than the representation in FIG. 2. FIG. 3 shows the course of the size of the crossing angle $\alpha$, represented in the form of a curve 31, over the winding width $B_{WG}$ of the cheese 3, wherein the values represent the traverse of the yarn guide 11 in FIG. 2 from left to right (traverse of the yarn guide 11 during the forward portion of the back-and-forth movement). At the left reversing point of the yarn guide 11, or at the left bobbin end edge 23, the crossing angle $\alpha$ passes through the zero point, and in the left end zone 20 it reaches the value of $\alpha_R$=35°. From the crossing angle $\alpha_R$=35°, the value decreases after a transition area down to a crossing angle $\alpha_M$=25°. The value of crossing angle $\alpha_M$=25° is maintained constant in the central zone 22. At the right side of the cheese 3, the value of crossing angle $\alpha_M$=25° rises again to $\alpha_R$=35° in the right end zone 21, and thereafter again passes through the zero point at the right reversing point of the yarn guide 11, or at the right bobbin end edge 24. The width of the central zone 22, in which the crossing angle $\alpha$ has the value $\alpha_M$=25°, takes up the preponderant portion of the winding width $B_{WG}$. The course of the crossing angle $\alpha$ in the course of the traverse of the yarn guide 11 in the return movement toward the left is indicated by dashed lines in FIG. 3.

The crossing angle $\alpha$ is set in a manner known per se, and therefore is not explained in detail herein. The crossing angle $\alpha$ is set by controlling the rotational speed of the cheese 3 and the speed of the traversing movement of the yarn guide 11 in the course of the traverse. The cylindrical cheese 3, which has been produced with a crossing angle $\alpha$ of $\alpha_R$=35° in the end zones 20, 21, has stable bobbin edges 23, 24 without an impermissibly high contact pressure being exerted. Consequently, bulges at the front face of the cheese 3 are prevented. The advantageously low crossing angle $\alpha$ of $\alpha_M$=25° in the central zone 22 located between the end zones 20, 21 makes possible an increased running length with a stable wound package and with the same production diameter of the cheese 3, for example 300 mm, which therefore contains 15% to 25% more yarn than conventional bobbins of the same diameter.

The unwinding behavior of the cylindrical cheese 3 has been improved by reducing the yarn running noise and suppressing the formation of loops and yarn entanglements.

The present invention is not limited to the embodiments represented. For example, the yarn guide can be alternatively embodied as a belt yarn guide or as a grooved roller. The crossing angle $\alpha$ of the cylindrical cheese of the present invention can advantageously assume alternative values in the range of 30° to 40° in the end zones 20, 21, and in the central zone 22 in the range of 15° to 28°.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of winding a rotor spun yarn onto a bobbin core into the form of a cylindrical yarn cheese, the method comprising the steps of traversing a yarn guide along the bobbin core for winding the yarn onto the bobbin core at a yarn crossing angle $\alpha$, the traversing of a yarn guide executing a lesser crossing angle $\alpha_M$ in a central zone centrally along the bobbin core between about 15° and about 28° , and a greater crossing angle $\alpha_R$ in end zones outwardly of the central zone adjacent opposite ends of the bobbin core.

2. The method in accordance with claim 1, wherein the crossing angle $\alpha_M$ in the central zone has a value between about 20° and about 26°.

3. The method in accordance with claim 1, wherein the crossing angle $\alpha_M$ in the central zone is at least about 8° smaller than the maximum crossing angle $\alpha_R$ in the end zones.

4. The method in accordance with claim 1, wherein the central zone comprises more than about 50% of the entire wound extent of the cheese.

5. The method in accordance with claim 1, further comprising the step of reducing a contact pressure of the cheese as the diameter of the bobbin increases.

6. The method in accordance with claim 1, further comprising the step of reducing the yarn tension as the diameter of the bobbin increases.

7. A yarn cheese comprising a rotor spun yarn wound in progressive yarn layers into a cylindrical form on a bobbin core, each yarn layer having a lesser crossing angle $\alpha_M$ in a central zone centrally along the bobbin core between about 15° and about 28° and a greater crossing angle $\alpha_R$ in end zones outwardly of the central zone adjacent opposite ends of the bobbin core.

8. The cheese in accordance with claim 7, wherein the crossing angle $\alpha_M$ in the central zone has a value of between about 20° and about 26°.

9. The cheese in accordance with claim 7, wherein the crossing angle $\alpha_M$ in the central zone is at least 8° smaller than the maximum crossing angle $\alpha_R$ in the end zones.

10. The cheese in accordance with claim 7, wherein the central zone having a reduced crossing angle $\alpha_M$ occupies more than about 50% of the entire wound extent of the cheese.

* * * * *